United States Patent [19]

Fraser

[11] 4,084,330

[45] Apr. 18, 1978

[54] FLASK FOR FREEZE DRYING WITH ADJUSTABLE SEAL

[75] Inventor: Douglas S. Fraser, New Platz, N.Y.

[73] Assignee: FTS Systems, Inc., Stone Ridge, N.Y.

[21] Appl. No.: 702,345

[22] Filed: Jul. 2, 1976

[51] Int. Cl.[2] ..... F26B 13/30

[52] U.S. Cl. ..... 34/92; 220/235; 220/237

[58] Field of Search ..... 34/5, 92, 242; 220/235, 220/237

[56] References Cited

U.S. PATENT DOCUMENTS

| | | | |
|---|---|---|---|
| 2,477,044 | 7/1949 | Carmean | 34/92 X |
| 2,886,067 | 5/1959 | Maxwell et al. | 220/235 |
| 3,293,773 | 12/1966 | Frazer et al. | 34/92 |
| 3,447,712 | 6/1969 | Galasso et al. | 220/237 |
| 3,474,543 | 10/1969 | Bender et al. | 34/92 X |
| 3,743,132 | 7/1973 | Larker et al. | 34/242 |
| 3,794,204 | 2/1974 | Wehmeyer | 220/235 |
| 4,024,648 | 5/1977 | Bender | 34/92 |

*Primary Examiner*—John J. Camby
*Attorney, Agent, or Firm*—Robert E. Wagner; Gerald T. Shekleton

[57] ABSTRACT

A flask for freeze drying being formed of chemically and thermally resistant materials, including a container flask and a cover assembly and having conduit means in the cover assembly for communication with the interior of the container flask and connection to a vacuum source. A filter is removably held in place by a sealing ring on the cover assembly over the point of communication of the tube with the container flask to prevent solid particles from being withdrawn by the vacuum and excludes contaminants on release of the vacuum. A resilient annular sealing ring is compressed between two movable portions of the cover assembly to sealingly engage the walls of the flask mouth and thereby provide a positive seal both at room temperature and in the face of the sudden temperature changes under vacuum which are present in freeze drying procedures.

7 Claims, 3 Drawing Figures

FLASK FOR FREEZE DRYING WITH ADJUSTABLE SEAL

BACKGROUND OF THE INVENTION

This invention relates in general to a freeze drying apparatus and, more particularly, to a freeze dry flask particularly adapted for use in freeze drying and similar laboratory procedures.

Freeze drying has been found useful in many fields, such as food technology, analysis of organic materials and other uses. It is ordinarily used where the need exists to remove water or other vaporizable liquids from a substance without destroying its cellular structure. Freeze drying provides the unique capability of allowing the removal of a solvent (usually water) from a solution or suspension by sublimination. This allows the material being freeze dried to remain in a frozen, solid state until it reaches a point of dryness or the solvent is extracted. Specimens or materials are usualy freeze dried in either a chamber-type freeze dryer or a nipple-type freeze dryer, using discrete containers.

There are a number of prerequisites, however, that any vessel or specimen container must have before it may be used in freeze drying, in order to overcome the various problems encountered in this operation. One problem includes the stress created due to the sudden subjection of the container to the sub-zero temperatures necessary for quick freezing, which could result in the tendency to crack and/or shatter many materials. This stress also can result in a loss of vacuum due to improper sealing. However, the sample container must be fluid-tight in order to be satisfactory for freeze drying procedures. For the purposes of this invention, the word "fluid" will encompass both the properties of a liquid and that of a gas or vapor.

An example of the prior art over which the present invention improves is U.S. Pat. No. 3,293,773 (D. S. Frazer et al.). Previous to the subject invention, the prior art depended on a threaded cap to secure such a seal. This arrangement, if properly sealed every time, would lead to a shortened life expectancy of the sealing means involved and the possibility of vacuum leakage with the adverse consequences. Further, the differences in materials of the cap, being generally plastic or metal, and the flask, being generally glass, would cause different rates and degrees of thermal expansion and contraction, rendering the efficiency of a generally reliable seal questionable during periods of fast temperature changes.

Another example of the prior art is the cap which depended upon O-rings as a sole source of a fluid-tight seal. O-rings would be placed about the perimeter of the cap, so that, upon insertion into the mouth of the cap, a seal would be formed between the cap and the walls of the flask. For a fluid-tight seal to be possible, it is necessary that the O-rings be in complete and close-fitting contact with the flask walls at every point, and that the O-rings retain their flexibility at the low temperatures associated with freeze drying, to assure constant contact with the irregular surface of the flask walls. To maintain the constant contact and close-fitting characteristics needed, a very tight fit is necessary. This tight fit required an excessive amount of force to insert and remove the container top, often causing spillage and other losses of sample, when exerting such force. Further the friction caused by its manner of insertion, in combination with the ultra-cold temperatures of freeze-drying results in a short life expectancy of the seals.

Other problems presented in freeze drying are that the solvents evaporated from the sample may be corrosive or otherwise damaging to the specimen container. Thus, while the container is supported with a great degree of care to negate the danger of implosion or breakage, it is desirable that the flask permit an easy removal of the freeze dried product and an easy clean-up after each use.

SUMMARY OF THE INVENTION

In order to solve these various problems, the safety freeze drying flask of the present invention was developed. The flask or vessel includes a sample container open at one end and a cap or cover assembly. The cap has a neck opening through which a connecting tube to the vacuum source may be inserted securely so that the vacuum flow is in communication with the interior of the container when the cap is secured to the top opening thereof. A filter may be mounted over the communicating opening of the connecting tube in the interior of the flask bottom by a retainer to prevent solid particles from being carried away in the vapor stream.

The filter of the present invention constitutes an improvement over that offered in the prior art in that while the latter presented difficulty in leakages, removal and cleaning, the present invention provides for easy installation and replacement of the filter and eliminates the problems of leakage.

The cap, which gives reliable fluid-tight vacuum seal during freeze drying, comprises an expanded O-ring formed of silicone rubber, which is sandwiched in an annular channel located between and formed by two plates. The bottom or retainer plate is of a size to easily fit into the mouth of the freeze drying flask, while the upper or compression plate is a portion larger than the mouth of the flask so that it rests on the flask while a smaller portion also fits inside the mouth of the flask. When these plates are compressed together by means, to be more particularly described below, the O-ring circumference is expanded to sealingly engage the interior walls of the mouth of the flask, thereby providing a reliable fluid-tight seal, even under the adverse conditions of sudden temperature changes. The silicone rubber forming the O-ring enables the seal to retain its resiliency at the low temperatures of freeze drying, while at the same time prolonging its life.

In an embodiment of the present invention, the container itself is composed of a tough, durable and chemically-resistant borosilicate glass. The filter used over the opening may comprise a large area replaceable filter. The cap is formed of a similarly tough and durable chemically-resistant material which is capable of being subjected to external stress at low temperatures to which the inventive apparatus is contemplated being subjected to. This material may be plastic, such as polycarbonate, however, other materials such as borosilicate glass or the like, which are capable of such performance, are also contemplated.

A better appreciation of the novel features of the present invention will be had upon a consideration of the following objects and detailed description.

Therefore, an object of this invention is a new and improved flask for use in freeze drying samples of various compositions.

It is a further object of this invention to provide a new and improved apparatus of uncomplicated structure adapted for use in freeze drying having a positive sealing means which will provide a reliable fluid-tight seal under the adverse conditions of freeze drying.

It is yet a further object of the present invention to provide a freeze drying apparatus which is resistant to most chemicals.

It is a still further object of the present invention to provide a new and improved freeze drying apparatus which is economically manufactured and assembled and provides for easy release of the cap after prolonged periods of use.

A still further object of this invention is to provide a new and improved freeze drying apparatus which is autoclavable and easily cleanable.

Objects other than those set forth will become apparent upon consideration of the accompanying drawings and detailed description to follow:

IN THE DRAWINGS

Figure 1:
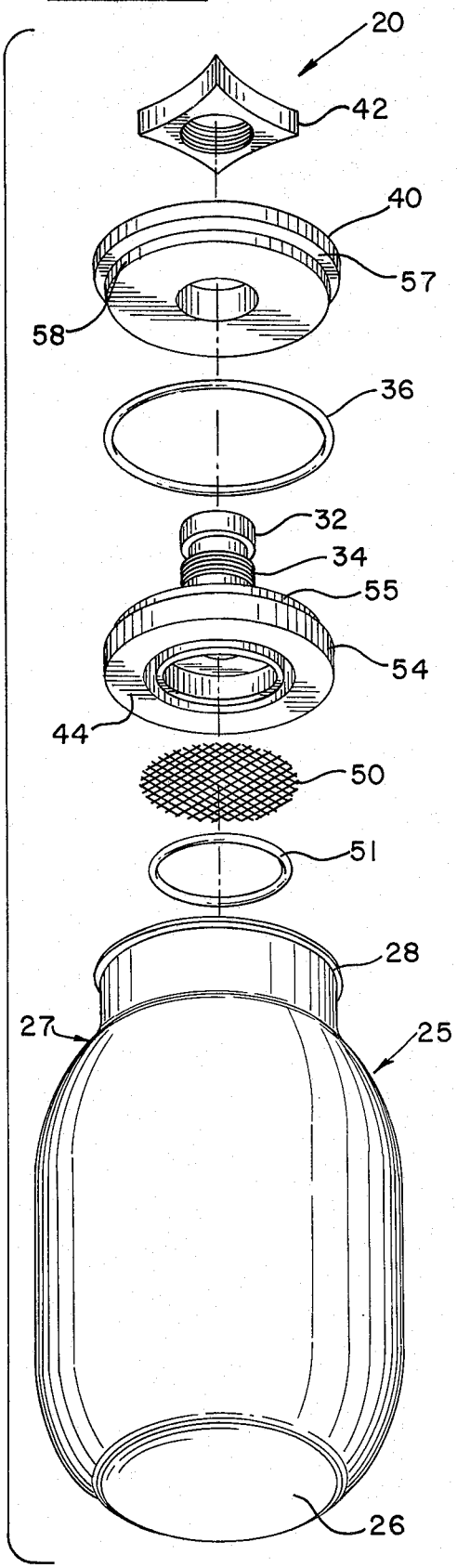
FIG. 1 is a side view of a preferred embodiment of the present invention.

Referring now to FIG. 1, the freeze dry flask 20 has a cap assembly 30 and a sample container or flask 25. This sample container 25 is preferably formed from a corrosion resistant material as borosilicate glass for durability in the face of strong solvent action or sudden changes in temperature. Further, such a material permits the flask to be autoclaved for sterilization purposes. The use of borosilicate or similar glass in the flask permits easy product removal and easy clean-up. The flask 25 also has a flat bottom 26 thereby assuring the entire assembly of self-standing capabilities. The interior of the flask has gently sloping sides 27 and a wide mouth 28 with smooth uninterrupted inner and outer walls thereby allowing the flask to be easily cleaned and autoclaved for future use.

Figure 2:
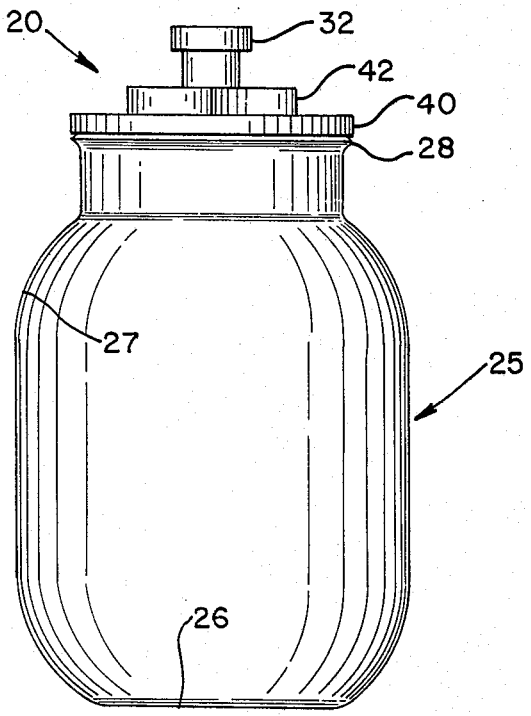
FIG. 2 is a cross section of the cap assembly of the present invention; and, FIG. 3 is an exploded view in perspective of a preferred embodiment of the present invention.
Figure 3:
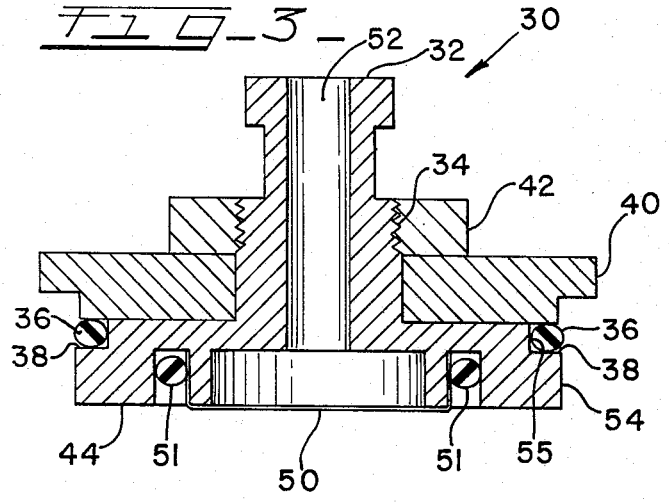

The cap assembly 30 is composed of a plurality of parts as can be better seen in FIG. 2. Its protruding neck 32 provides a passageway 52 through to the interior of the flask 25. This passageway 52, when connected to a suitable vacuum source (not shown), provides a vacuum flow from the vacuum source into the flask 25. A large area replaceable filter 50 is located over the passageway 52 on its internal side and secured by suitable retainer means to prevent solid particles from being carried away in a vapor stream which may be caught up in the vacuum flow.

The neck 32 is integral at its lower end with a circular retention plate of a slightly smaller diameter than the interior diameter of the mouth 28 of the flask 25. An upper compression plate 40 is formed with an opening at its center to allow this upper plate 40 to be placed over the neck 32 and directly above the lower plate 44. The retention plate 44 is formed in two portions, one portion having a diameter slightly less than the mouth of the flask 54 and a smaller portion 55, forming in in effect, a shoulder on the upper periphery of the retention plate 44 which shoulder provides a seat for an O-ring 36.

The compression plate 40 is also formed of two portions, an upper portion 57 being of a larger diameter than the mouth of the flask 25 and a lower portion 58 being of a diameter slightly smaller than the mouth of the flask 25. Thus, the compression plate may rest on the top of the mouth of the flask 28 by virtue of the shoulder thereby created.

When the compression plate 40 is placed over the neck 32 adjacent the retention plate 44, an annular channel 38 is formed. Placed into the channel 38 is an O-ring of sufficient size to maintain a spaced relationship at all time between the compression plate 40 and the retention plate 44. The O-ring is formed of silicone rubber or other material which is suitably long lived under extremely cold temperatures, retaining its resiliency at such extremes and after changes back to ambient temperatures.

Intermediate the upper portion of the neck 32 and the compression plate 40 is a threaded neck portion 34. A compression nut is positioned on this threaded portion in such a manner that when the cap assembly 20 is fitted into the mouth 28 of the flask 25, as shown in FIG. 1, and the compression nut 42 is tightened, the compression plate 40 is forced down into the O-ring 36 causing the O-ring 36 to flatten and protrude from the annular channel 38. The compression nut 42 is tightened sufficiently to allow contact with the circumferential interior wall of the mouth 28 of the flask 25 to sealingly and tightly engage the mouth 28 of the flask 25. The compression nut 42, in the preferred embodiment, is a radiused square, having sharply protruding corners allowing it to be easily tightened and released.

In this manner the resilient O-ring can accommodate any and all thermal expansion and contraction of the glass which commonly occurs during the freeze drying operation. Thus, one need not concern himself with the varying thermal expansion properties of the cap material in relation to the flask composition as the resilient O-ring accommodates for these differences in tolerances and rates of expansion. Further, the cap can be released from the flask while still cold, as a result of the resiliency of the silicone rubber forming the O-ring. The O-ring thus, will not crack or deform at such low temperatures or while the temperature is suddenly elevated or lowered.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

I claim:

1. A vessel assembly for freeze drying formed of materials reisstant to chemical action and extremes in temperature and pressure comprising a sample container having a mouth and an interior wall surface at an open end thereof, a cover assembly, said cover assembly being adapted for mounting in a positive fluid-tight manner to close said mouth, said cover assembly including a compression plate and a retainer plate, said retainer plate having an annular channel on an upper surface, said retainer plate being integral with an upstanding neck, said neck having a passageway for attachment to a vacuum source for the application of vacuum to said sample container, said passageway being in communication with the interior of said sample container when said cover assembly is mounted on said mouth of said container, said compression plate having a radially extending flange providing a seat for placement of said cover assembly on said mouth, said retainer plate being adjustably movable towards said compression plate, a resilient annular sealing means in a given position between said retainer plate and said compression plate, said retainer plate and said compression plate engaging said sealing means on opposing sides and compressing said sealing means for radial expansion outward while being retained in said given position, said compression being caused by the movement of said retainer plate towards said compression plate for the engagement of said compression sealing means with said interior wall surface of said sample container in a reliable thermally resistant fluid-tight seal while retaining said constant radius.

2. The vessel assembly of claim 1 wherein said retainer plate and said compression plate expand said resilient annular sealing means by a compression nut engaged on a threaded portion of said neck in a manner to move said compression plate toward said retainer plate when rotated, and thereby compress said sealing means located between said retainer plate and said compression plate.

3. The vessel assembly of claim 1 wherein said sample container is formed of borosilicate glass.

4. The vessel assembly of claim 1 wherein a large area replaceable filter is mounted in one of said plates in the vacuum path to prevent solid particles from being carried away and to prevent the entry of foreign matter upon the release of the vacuum.

5. The vessel assembly of claim 1 wherein said resilient annular sealing means, when expanded, provides a positive fluid-tight seal during extreme changes in temperature while under a vacuum and at the low temperatures associated with freeze drying.

6. The vessel assembly of claim 5 wherein said resilient annular sealing means is formed of a silicone rubber.

7. The vessel assembly of claim 1 wherein said compression plate is adjustably movable towards said retainer plate by a compression nut having sharply protruding corners allowing easy rotation for the application of force in moving said compression plate.

* * * * *